US005535951A

United States Patent [19]

Utter

[11] Patent Number: 5,535,951

[45] Date of Patent: Jul. 16, 1996

[54] MISTING APPARATUS

[76] Inventor: Steven Utter, 419 W. Greentree, Chandler, Ariz. 85224

[21] Appl. No.: 927,231

[22] Filed: Aug. 7, 1992

Related U.S. Application Data

[63] Continuation of Ser. No. 698,356, May 7, 1991, abandoned, which is a continuation of Ser. No. 376,380, Jul. 6, 1989, abandoned.

[51] Int. Cl.[6] ..... B05B 9/04

[52] U.S. Cl. ..... 239/322; 239/373; 239/581.1; 222/95

[58] Field of Search ..... 222/95; 239/320, 239/321, 322, 323, 569, 581.1, 373, 397

[56] References Cited

U.S. PATENT DOCUMENTS

| | | | |
|---|---|---|---|
| 876,453 | 1/1908 | Heard | 239/550 |
| 1,731,767 | 10/1929 | Cramer | 239/323 |
| 2,911,157 | 11/1959 | Converse | 239/152 |
| 3,018,970 | 1/1962 | Wittenberg et al. | 239/323 |
| 3,116,856 | 1/1964 | Prussin et al. | 239/581.1 |
| 3,184,113 | 5/1965 | Curtis | 239/323 |
| 3,450,163 | 6/1969 | Mercier et al. | 138/30 |
| 3,469,578 | 9/1969 | Bierman | 222/95 |
| 3,524,475 | 8/1970 | Kirk, Jr. | 138/30 |
| 3,802,511 | 4/1974 | Good, Jr. | 239/154 |
| 4,043,510 | 5/1977 | Morris | 239/222 |
| 4,048,994 | 9/1977 | Lo | 222/95 |
| 4,206,877 | 6/1980 | Hoza, III | 239/581.1 |
| 4,458,830 | 7/1984 | Werding | 239/323 |
| 4,721,250 | 1/1988 | Kennedy et al. | 239/383 |
| 4,867,344 | 9/1989 | Bitterly | 239/323 |
| 4,875,508 | 10/1989 | Burke, II et al. | 222/95 |
| 5,069,363 | 12/1991 | Daimler | 222/95 |

FOREIGN PATENT DOCUMENTS

| | | | |
|---|---|---|---|
| 754269 | 11/1933 | France | 239/323 |
| 1912328 | 3/1968 | Germany | 239/323 |
| 387374 | 5/1965 | Switzerland | 239/323 |

*Primary Examiner*—Andres Kashnikow
*Assistant Examiner*—Christopher G. Trainor
*Attorney, Agent, or Firm*—Fulwider Patton Lee & Utecht

[57] ABSTRACT

An apparatus for delivering a fine spray mist to cool a localized area by evaporative cooling. The apparatus consists of a pressurizable tank, a valve for activating the release of fluid from the pressurizable tank, and a spray nozzle or a plurality of spray nozzles coupled to the valve by a quick connect coupler.

1 Claim, 3 Drawing Sheets

MISTING APPARATUS

This is a continuation of application Ser. No. 07/698,356 filed May 7, 1991, now abandoned, which is a continuation of Ser. No. 07/376,380 filed on Jul. 6, 1989, now abandoned.

BACKGROUND OF THE INVENTION

The present invention consists generally of an apparatus for delivering a fine spray mist to cool a localized area by evaporative cooling. It is a well know principal that introduction of humidity into a dry atmosphere lowers the ambient atmospheric temperature. Evaporative or "swamp" coolers served as effective refrigeration devices in desert climates for over fifty years. The present invention provides an apparatus which utilizes this evaporative cooling principle in a easy-to-use, portable and efficient manner. More specifically, the present invention consists of a pressurizable tank, a valve for activating the release of fluid from the pressurizable tank, and a spray nozzle coupled to the valve by a quick connect coupler as is known in the art. According to the preferred embodiments of the invention, the pressurizable tank may be of sufficient size and in acceptable packaging to make the entire apparatus portable by hand-carrying, adapted to be worn in a backpack-like configuration or be substantially stationary as a free standing unit.

There are presently no known portable misting apparatus which for delivering humidity into a dry atmosphere to lower the ambient atmospheric temperature in a localized area. What is known in the spraying apparatus art are a variety of devices for directing and applying a spray of fluid to an object, such as crops, lawns, weeds or fire. Generally, these devices may be broadly classified into two categories. The first group, consisting of motor driven sprayers, is represented by U.S. Pat. Nos. 3,421,697 issued to Marks on Jan. 14, 1969, 3,539,110 issued to Kobayashi on Nov. 10, 1970, 3,802,511 issued to Good, Jr. on Apr. 9, 1974 and 4,651,903 issued to Pagliai on Mar. 24, 1987. This first group of patents broadly disclose portable backpack-like sprayers. The second group, consisting of non-motor-driven sprayers, is represented by U.S. Pat. Nos. 2,911,157 issued to Converse on Nov. 3, 1959, 3,352,364 issued to De Coste on Nov. 14, 1967, 3,993,245 issued to Smith on Nov. 23, 1976, and 4,688,643 issued to Carter et al on Apr. 25, 1987. Of this second group, only the patents issued to Coste and Smith disclose a sprayer having a pressurizable container and a spray nozzle. In the de Coste patent, the fluid in the container is directly pressurized by introduction of pressurized air through an air valve into the fluid container. Upon exhaustion of the air pressure within the container, the container must be re-pressurized from a pressurized air source. The Smith patent discloses a spraying device having a pressurizable container where a manual air pump is used to pressurize the fluid within the container.

Thus, an examination of the spraying apparatus art clearly discloses that containers for the fluid are pressurized by either motor power, air pressure directly applied to the fluid chamber or manual pumping. The motor powered sprayers tend to be heavy, noisy, cumbersome to use and require either fuel or an electrical cord connecting the sprayer to an electrical source. The air pressurized sprayers require that the user has constant access to a source of pressurized air to recharge the container, while the manual pumped containers provide limited pressurization and require manual effort to pressurize.

U.S. Pat. No. 3,524,475 entitled "Expansion Tank" issued Aug. 18, 1970 to Chester Kirk discloses a tank, the interior of which is divided into two chambers by a flexible diaphragm. One of the chambers is adapted to be pre-charged by a pressurized gas, while the other chamber is adapted to receive a fluid. This patent discloses a tank which is sold and marketed by Amtrol under the trademark DIATROL as a shock suppressor to prevent water knock in plumbing. Thus, the known use for the tank disclosed by U.S. Pat. No. 3,524,475 is to fluid pressure within a closed fluid circuit.

It will be understood, therefore, by those skilled in the relevant art, that there is no known spray cooling apparatus for evaporative cooling a localized area which employs a refillable constantly pressurized tank, a valve for activating a flow of pressurized fluid from the tank and a quick-connect coupling for coupling and decoupling a variety of spray nozzle attachments.

SUMMARY OF THE INVENTION

Accordingly, it is a broad aspect of the present invention to provide a misting apparatus which utilizes a tank container such as that disclosed in U.S. Pat. No. 3,524,475 having a resilient pressurizable gas bladder defining a pressurizable gas chamber within the bladder and a fluid chamber defined by the fluid container surrounding the pressurizable gas bladder, a valve for activating a flow of pressurized fluid from the fluid container, and a spraying nozzle attachment having a quick-connect coupling for rapidly removing and re-coupling the spraying nozzle attachment.

DESCRIPTION OF THE PREFERRED EMBODIMENTS OF THE INVENTION

Figure 1:
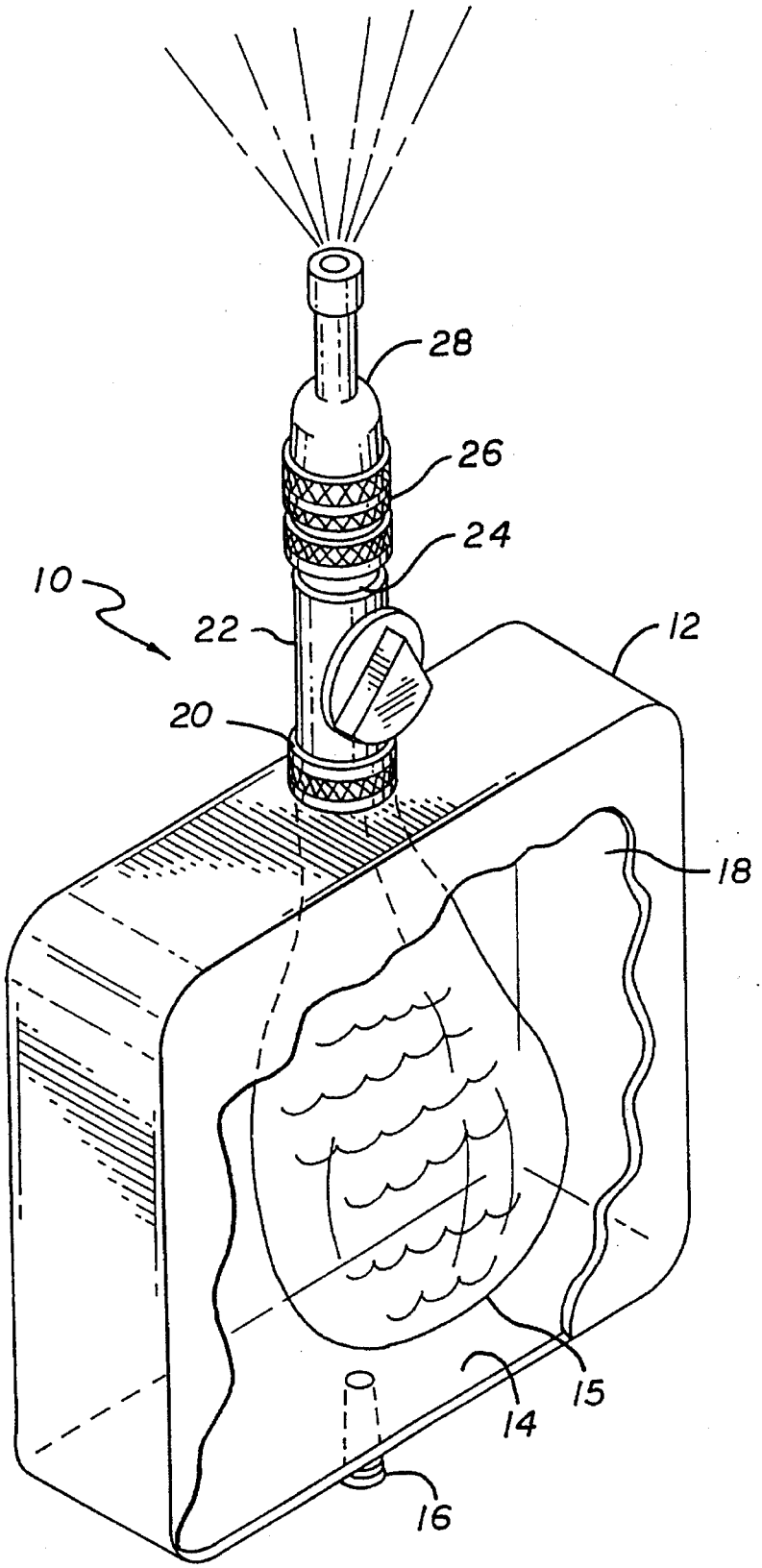
FIG. 1 is a perspective partial cross sectional view of the misting apparatus of the present invention.

With reference to the accompanying Figures, in which like structural and functional features are identified by like reference numerals, there is disclosed the misting apparatus 10 of the present invention. With particular reference to FIG. 1, misting apparatus 10 consists generally of a fluid tank 12, a flow valve 22 coupled to a fluid outlet 20 of the tank, a quick-connect coupling consisting of male fitting 24 coupled to the fluid outlet 20 and female fitting 26 which rapidly couples and decouples a spray nozzle attachment 28 to the male fitting Fluid tank 12 defines an inner fluid chamber 18 having a fluid outlet 20. A pressurizable gas chamber 14 is defined which inner fluid chamber 18, and communicates with a gas valve 16, such as a SCHRADER valve, for introducing a gas, under pressure, into the pressurizable gas chamber 14. According to the present invention, it is desirable to employ a resilient bladder 15 to define either the gas chamber 14, as illustrated by FIG. 1, or as the fluid chamber 18.

It will be understood, by those skilled in the art, that pressurization of gas chamber 14 creates a static pressure within gas chamber 14 and a pressure differential between gas chamber and empty fluid chamber 18. Introduction of a fluid into fluid chamber 18, under pressure which exceeds that of the pressure within gas chamber 14 will cause compression of gas chamber 14 by the fluid filling fluid chamber 18 until a steady state pressure equilibrium exists between the fluid pressure within fluid chamber 18 and the gas pressure within gas chamber 14.

Thus, it will be understood, for example, if the gas pressure within gas chamber 14 is 50 p.s.i. and fluid is introduced into fluid chamber 18 at a pressure greater than 50 p.s.i., the fluid will fill the fluid chamber 18, thereby compressing gas chamber 14 until a steady state pressure equilibrium between the chamber is achieved. At that equilibrium point, no further fluid may be introduced, except at elevated pressure. At equilibrium, such as occurs when valve 22 is closed, the compressive forces of the fluid equal the expansive forces of the gas. When valve 22 is opened, the fluid is immediately exposed to the ambient pressure and the expansive forces of the gas within gas chamber 14 propel the fluid from fluid chamber 18 into fluid outlet 20 and out of tank A quick-connect coupling, consisting of a male fitting 24 and a female fitting 26, is provided to permit easy coupling and decoupling of spray nozzle attachment 28 and refilling of tank by attachment to any source of pressurized water, such as an external hose bib. According to another embodiment of the invention, there is provided an alternate coupling consisting of an external threaded end and an internal threaded end which operably couples the flow regulator valve 22 to conduit 27. It is desirable, though not required, to interdispose a swivel coupling between the external threaded end and internal threaded end to permit free rotation of the entire spray nozzle assembly. Conduit 27 may be any type of tubing or hose which conducts the fluid flow from flow regulator valve 22 to spray nozzle It is desirable, according to one preferred embodiment of the invention, to utilize fluid outlet 20 and flow regulator valve both to control the flow of fluid out of tank 12 and introduction of fluid into tank 12. Introduction of pressurized fluid into tank 12 requires either an additional female fitting 26 which may be coupled, at one end, to a hose bib and then coupled to male fitting 24 or a suitable adapter for directly coupling valve 24 to a hose bib or other pressurized fluid source.

Figure 3:
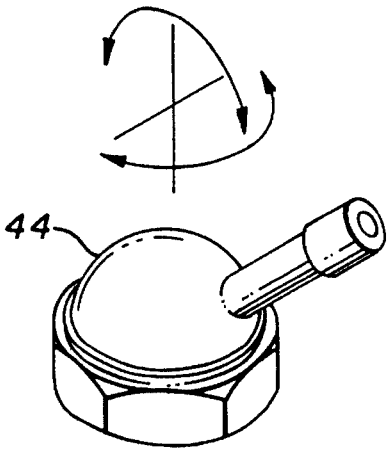
FIG. 3 is a plan view of a freely rotatable spray nozzle attachment in accordance with the present invention.

Spray nozzle attachment 28 may consist of a variety of different attachments, such as, for example, a spray nozzle, a flexible tube terminating in a spray nozzle, a telescoping tube terminating in a spray nozzle or a freely rotating directional nozzle 44 in FIG. 3, capable of emitting a multi-directional spray. It will also be understood, by those skilled in the art, that a plurality of spray nozzles may also be employed.

In accordance with an alternative preferred embodiment of the invention, as illustrated with reference to FIG. 4, there is shown a backpack-like misting apparatus 40 in accordance with the present invention. Misting apparatus 40 consists of an outer shell 42 having shoulder straps 46 to facilitate carrying by a person. Disposed within outer shell 42 is a fluid tank 12 substantially as described above. In this preferred embodiment of the invention, however, flow regulator valve 22 preferably consists of a three-way valve coupled at one end to tank 12 and capable of opening either to spray nozzles 44 for emitting a misting spray or to an external coupling 48 for coupling to a pressurized water source for introduction of fluid into tank 12. Flow regulator valve 22, therefore, activates the spray from spray nozzles 44, opens the external coupling 48 for introduction of fluid into tank 12 or is closed. An air valve 16 extends through outer shell 42 and communicates with the gas chamber (not shown) within tank 12 to pressurize the gas chamber.

Figure 4:
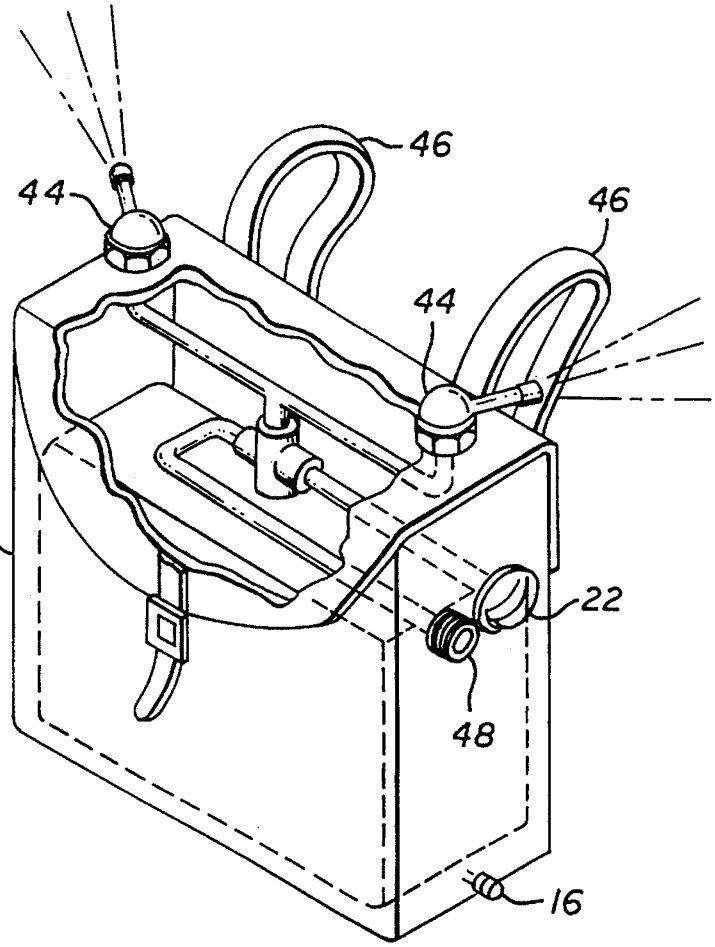
FIG. 4 is a perspective partial cut-away view of a preferred embodiment of the present invention.
Figure 2:
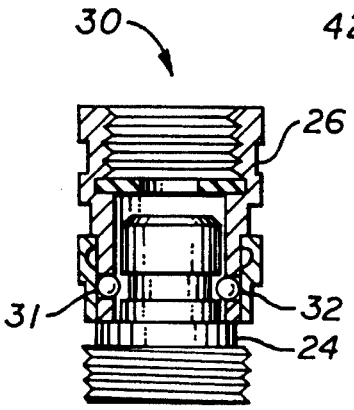
FIG. 2 is a side elevational cross sectional view of a quick-connect coupling for removing and re-coupling a spray nozzle attachment of the present invention.
Figure 5:
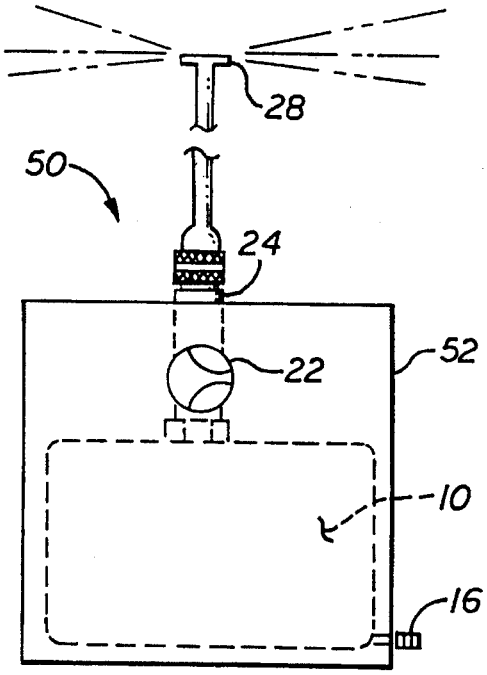
FIG. 5 is a side elevational view of another preferred embodiment of the present invention.
Figure 6:
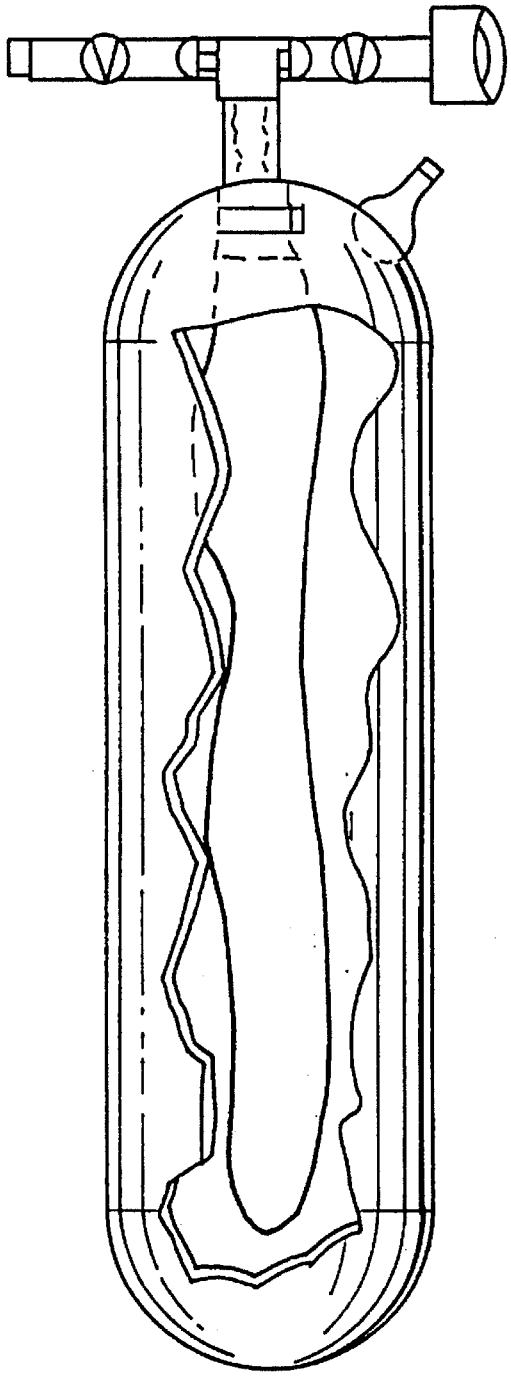
FIG. 6 is a side view of another preferred embodiment of the invention.

Finally, there is contemplated another preferred embodiment which is illustrated in FIG. 5 consisting of a self-standing misting apparatus 50 which employs like features and function as the misting apparatus 10 and 40 depicted in FIGS. 1 and 4, respectively. Misting apparatus 50 consists of an outer shell which may be self-supporting, containing a fluid tank 12 and the associated flow regulator valve 22 and air valve 16 which communicate between the outer shell 52 and the fluid tank 12 as hereinbefore described. The quick-connect coupling 24, 26 is preferably provided external to the outer shell 52, but depending upon specific design considerations, may be incorporated within outer shell 52. A stem 54 communicates between quick-connect coupling 24, 26 and spray nozzle 28 to conduct pressurized fluid from fluid tank 12 to spray nozzle 28. Again, it will be understood by those skilled in the art, that stem 54 may consists of flexible tubing, rigid tubing, telescoping tubing or such other fluid conduit as may be appropriate for the desired end use of the misting apparatus 50.

In accordance with the broad objects of the present invention, there has been disclosed and described, and hereinafter claimed, a misting apparatus adapted to deliver a spray of fluid and evaporatively cool a localized area. While the invention has been particularly shown and described in reference to the preferred embodiments thereof, it will be understood by those skilled in the art that changes in form and details may be made without departing from the spirit and scope of the invention.

I claim:

1. A method for emitting an atomized spray of a fluid to a localized area for evaporatively cooling the localized area around a person, comprising the steps of:

providing an apparatus comprising an outer housing defining an interior chamber, and a resilient fluid bladder disposed within said interior chamber, said resilient fluid bladder being in fluid flow communication with a fluid opening of said outer housing, said fluid opening further having a fluid flow valve associated therewith, a threaded adaptor or connector for attaching the fluid opening to a pressurized fluid source, and a spray nozzle having a fluid flow orifice of sufficient size to emit a misted spray therefrom, said outer housing further having a gas valve in communication with said interior chamber;

charging said outer housing with a gas charge, thereby pressurizing said outer housing such that said gas charge impinges upon said resilient fluid bladder;

attaching the threaded adaptor or connector to the pressurized fluid source, the pressurized fluid source having enough pressure to overcome the initial gas-charge;

introducing the fluid into said resilient fluid bladder thereby increasing the pressure of said gas charge within said outer housing having the effect of filling and recharging the apparatus at the same time;

evacuating said fluid charge from said resilient fluid bladder through said fluid opening of said outer housing by opening said fluid flow valve associated with said fluid opening, whereby said resilient bladder impinges upon said fluid contained within said resilient fluid bladder and exerts a positive pressure upon said fluid, thereby forcing said fluid through said spray nozzle;

emitting said evacuated fluid charge through said orifice of said spray nozzle as a misted spray; and allowing said misted spray to evaporate into the localized area around a person, thereby decreasing the ambient temperature in the localized area by evaporative cooling.

* * * * *